United States Patent [19]

Haisman

[11] Patent Number: 4,858,255

[45] Date of Patent: Aug. 22, 1989

[54] HYDROTHERAPY APPARATUS HAVING PREHEATED AIR AGITATION FEATURE

[75] Inventor: William H. Haisman, Los Angeles, Calif.

[73] Assignee: Premier Pump & Pool Products, Inc., Los Angeles, Calif.

[21] Appl. No.: 113,174

[22] Filed: Oct. 23, 1987

Related U.S. Application Data

[63] Continuation of Ser. No. 866,889, May 23, 1986, abandoned, which is a continuation of Ser. No. 685,310, Dec. 24, 1984, abandoned.

[51] Int. Cl.[4] ..... A61H 33/02

[52] U.S. Cl. ..... 4/544; 4/542

[58] Field of Search ..... 4/488, 492, 493, 509, 4/541-544, 567-569; 417/350, 368, 371; 415/143; 310/62, 63; 237/12.3 R, 12.3 A, 12.3 B

[56] References Cited

U.S. PATENT DOCUMENTS

| | | | |
|---|---|---|---|
| 2,251,370 | 8/1941 | Motzer | 237/12.3 |
| 2,776,385 | 1/1957 | Modrey | 310/71 |
| 2,789,238 | 4/1957 | Staak | 310/88 |
| 3,092,101 | 6/1963 | Kinney | 128/66 |
| 3,943,580 | 3/1976 | Carter . | |
| 3,946,449 | 3/1976 | Mathis . | |
| 4,115,878 | 9/1978 | Johnson et al. . | |
| 4,264,039 | 4/1984 | Moreland | 239/428 |
| 4,325,149 | 4/1982 | Moreland | 4/488 |

FOREIGN PATENT DOCUMENTS 378615 7/1931 United Kingdom .

*Primary Examiner*—Henry J. Recla
*Assistant Examiner*—Linda J. Sholl
*Attorney, Agent, or Firm*—Barnes & Thornburg

[57] ABSTRACT

A hydrotherapy apparatus is provided with agitating air being preheated by the pump motor to avoid cooling the heated water, by confining the agitating air in thermal exchange relationship with the waterpump motor.

21 Claims, 3 Drawing Sheets

HYDROTHERAPY APPARATUS HAVING PREHEATED AIR AGITATION FEATURE

REFERENCE TO RELATED APPLICATIONS

This is a continuation of patent application Ser. No. 866,889, filed May 23, 1986 now abandoned which is a continuation of application Ser. No. 685,310 filed Dec. 24, 1984 now abandoned.

This invention has to do with hydrotherapy apparatus and more particularly with hydrotherapy apparatus in which heated water is recirculated to and from a tub and mixed with ambient air for agitation of the water. Such ambient air is typically cooler than the heated water and tends to cool the water and reduce the benefits of the hydrotherapy. The present invention uses available heat sources to preheat the ambient air before mixing with the recirculating water.

TECHNICAL BACKGROUND

Hydrotherapy involves circulating heated water around the body, optimally while air agitating the water for added massaging action. The use of cool, ambient air, however, cools the heated water and reduces the hydrotherapy benefits. In smaller installations such as in the home, a separate heater may not be provided for the water beyond the heat afforded by the household hot water heater, and therapy tubs in such circumstances are difficult to keep at adequate temperatures. The use of continuously running fresh hot water to maintain heat in the therapy tub is wasteful of energy and unduly expensive.

SUMMARY OF THE INVENTION

It is accordingly an object of the invention to provide a hydrotherapy apparatus in which heat is maintained by the use of a low, or no, increased cost source: the motor of the water pump. It is another object to provide a method and apparatus for hydrotherapy in which the ambient air is preheated before mixing with the recirculating water by convection against the pump motor. It is a further object to run pump motors cooler and/or at higher outputs for a given capacity motor by more efficiently cooling such motors by convection against ambient air being positively displaced over the motor surface for preheating of the air. Other objects will appear hereinafter.

These and other objects of the invention are realized in hydrotherapy apparatus having a tub for containing a supply of heated water, a water pump for recirculating the heated water supply to and from the tub, a motor for operating the pump, and means to mix ambient air into the water for air agitation thereof, the mixing means including a confined passage having a terminus in the water, the ambient air normally being of a temperature tending to cool the heated water, by the provision of the improvement comprising the water pump motor and confined passage being relatively arranged for convection heating of confined air by the heat of operation of the motor for preheating the air confined within the passage before mixing thereof with the heated water supply.

In particular embodiments of the hydrotherapy apparatus of the invention: the water supply is carried in piping beyond the tub, and the apparatus includes also an outlet into the piping, the outlet defining the confined passage terminus for mixing the air with the water in agitating relation; the water piping defines a venturi structure at the air outlet for drawing the air into the water supply; there is included also positive displacement means within the passage for urging ambient air through the passage in confined relation; there is included also air compression means within the passage for increasing the pressure of the air above ambient in advance of mixing air with the water for improved air agitation of the water; and the confined passage has a locally relatively reduced cross-section defining a convection heating zone for the air, the motor at least partially defining the reduced passage cross-section.

In a preferred embodiment, the confined passage comprises a wall in closely spaced relation with the motor, the wall and motor defining a convection heating zone therebetween; there is included also fan means driven by the motor for positively displacing ambient air through the convection heating zone, the fan means blowing ambient air across the motor within the convection zone toward the passage terminus; and there is also included an air compression means between the motor and the passage terminus, the compression means comprising a turbine driven by the motor and adapted to increase the pressure of the air above ambient and urge the air toward the passage terminus.

In particularly preferred embodiments: the convection heating zone is generally annular and defined by the passage wall surrounding the motor; the water supply is carried in piping beyond the tub, and included also is an outlet into the piping, the outlet defining the confined passage terminus for mixing the air with the water in agitating relation; the water piping defines a venturi structure at the air outlet for drawing the air into the water supply; included also within the passage is positive displacement means at the upstream side of the motor before the convection heating zone, the displacement means comprising a fan driven by the motor for urging ambient air through the passage in confined relation; included also within the passage is air compression means at the downstream side of the motor after the convection heating zone, the compression means comprising a turbine compressor for increasing the pressure of the air above ambient in advance of mixing air with the water at the outlet for improved air agitation of the water; and the pump, the fan and the compression turbine are driven by a common shaft of the motor.

In another embodiment the invention provides a hydrotherapy apparatus comprising a pump and motor therefor, a heated water supply to be circulated by the pump and motor to and from a hydrotherapy tub, an air supply to be mixed with the water in agitating relation, and an air preheater comprising a wall defining an air supply passage, the wall enclosing the motor for convection heating of the air supply within the passage in advance of mixing the air with the water. In this and like embodiments there is also provided air displacement means urging the air through the passage in convection heating relation.

The invention further contemplates a method of operating a hydrotherapy apparatus including circulating heated water to and from a hydrotherapy tub with a motor driven pump, mixing agitating air into the water, and preheating the air by passing the air across the motor in convection heating relation before mixing with the water, as by maintaining a pressure differential across the motor to effect air flow thereacross.

THE DRAWING

The invention will be further described as to an illustrative embodiment in conjunction with the attached drawings in which.

PREFERRED MODE

Figure 1:
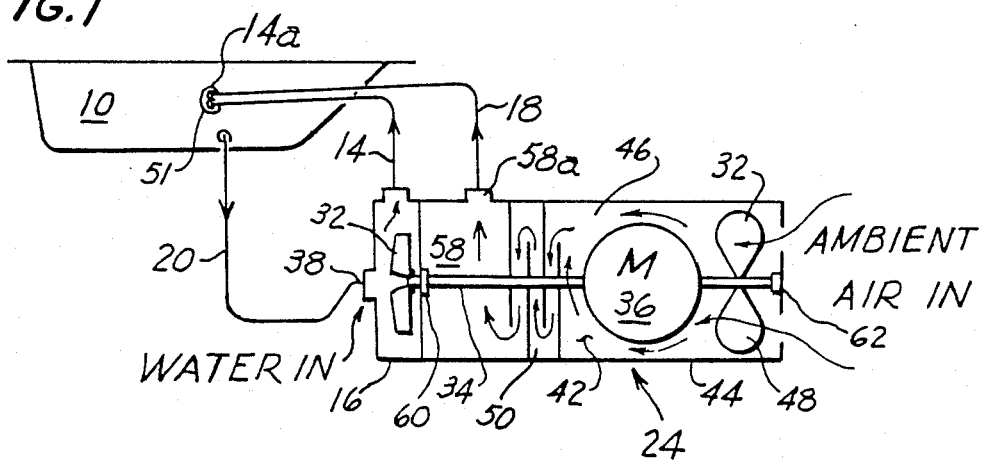
FIG. 1 is a schematic view of the hydrotherapy apparatus of the invention.
Figure 3:
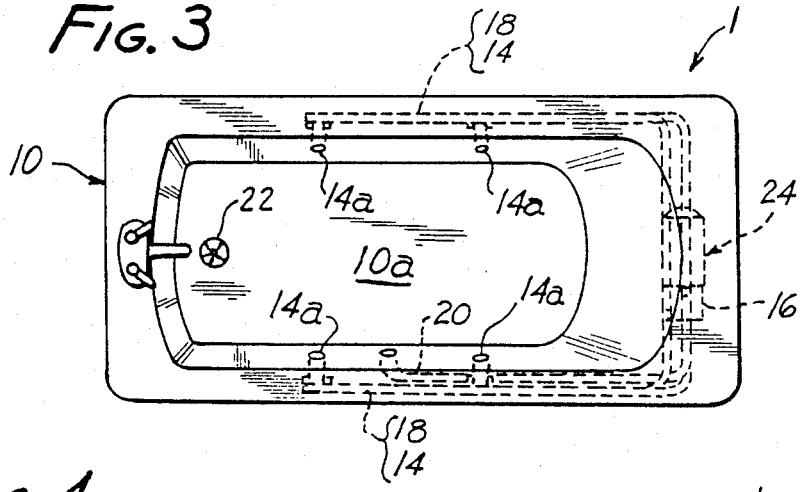
FIGS. 3, 4 and 5 are respectively, top plan, side elevation and end elevation views of the hydrotherapy apparatus.
Figure 4:
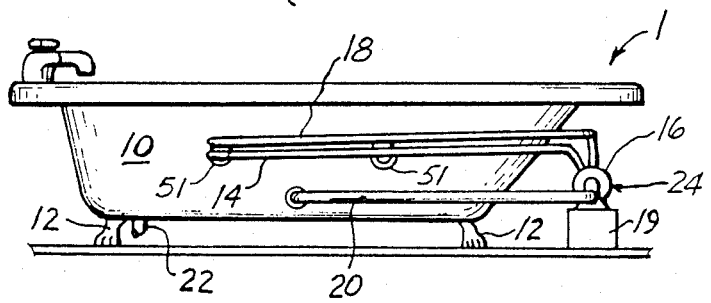
Figure 5:
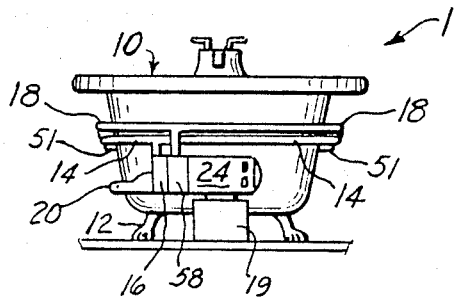

With reference now to the drawing in detail, in FIGS. 1, 3, 4 and 5 the hydrotherapy apparatus 1 comprises tub 10 which stands on feet 12 and has encircling water feed piping 14 communicating the pump 16 with circumferentially spaced outlets 14a into the tub interior 10*a*. Return piping 20 drains the water from the tub interior 10*a* for return to the pump 16. The pump 16 is elevated onto a pedestal 19 of FIGS. 4 and 5 and the feed and return piping 14, 20 sloped thereby to ensure reverse flow into the tub interior 10*a* when the apparatus is shut down, for draining through water waste line 22 of FIGS. 3 and 4. In use, the tub 10 is filled with heated water, the pump 16 recirculates the heated water to the tub via feed piping 14 and outlets 14a while simultaneously drawing water from the tub via return piping 20. Filter and supplemental heating means can be provided in the apparatus but are not shown.

In addition to the pump 16, an air supply means, generally indicated at 24, is provided for the purpose of sparging air into the recirculating water, the water being thus agitated and of increased therapeutic action thereby. The air supply means 24 delivers ambient air into the recirculating water. If, as is the likely case, the ambient air is lower in temperature than the heated water, the water is cooled as the air is entrained into it, until the water temperature becomes to cool to be comfortable. While this condition can be overcome by the use of supplemental heating, or the addition, even continuously, of additional heated water to the tub, such expedients are energy wasteful and far less efficient and desirable than the solution taught herein which uses heat, otherwise wasted, to preheat air for mixing with the recirculating water.

With reference to FIGS. 1–5, the present invention provides means for preheating ambient air before mixing it with the recirculating heated water. As shown in FIG. 1, a centrifugal pump 16 having an impeller 32 mounted on shaft 34 driven by motor 36 displaces water entering the pump 16 at 38 from piping 20 into feed piping 14 for recirculation to the tub 10. Air is preheated by the preheating apparatus shown at 24 to be described in detail hereinafter, and passed to the recirculating water via piping 18.

Figure 6:
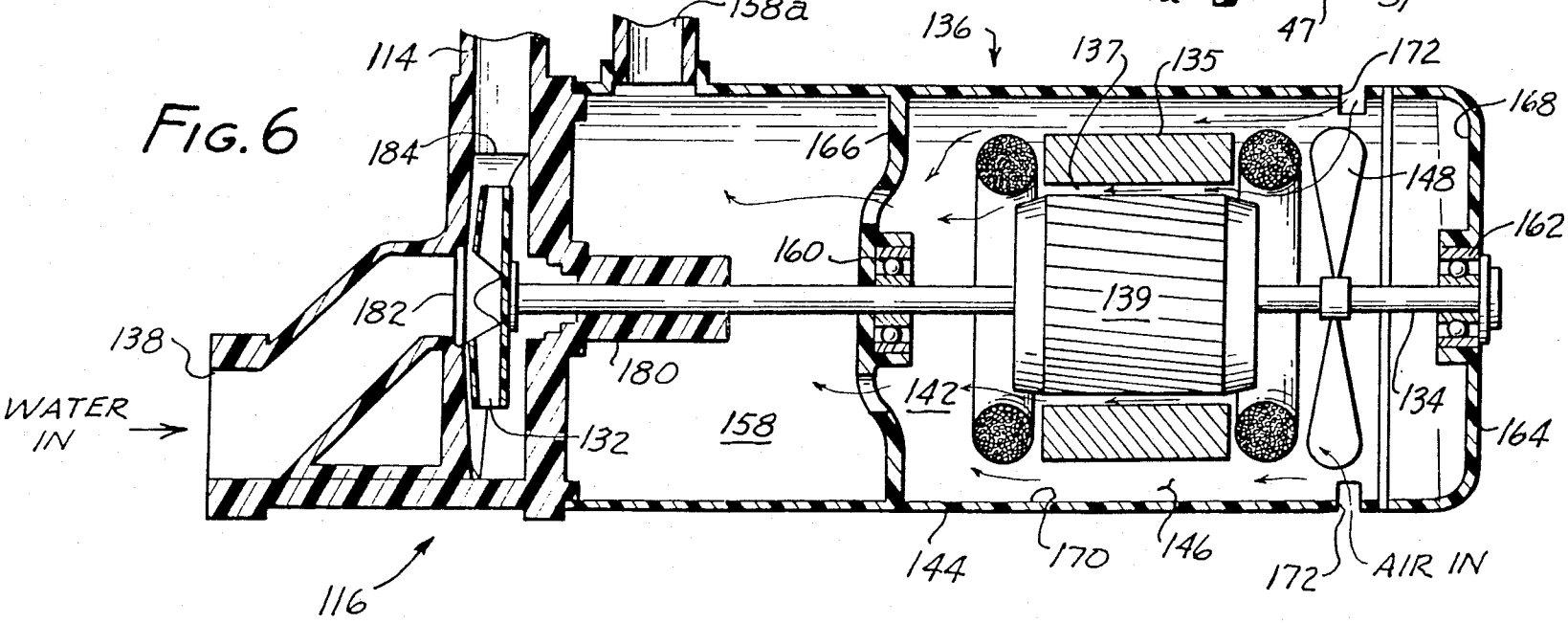
FIG. 6 is a view in vertical section of an alternate embodiment of the air preheating apparatus.

The recirculating water is mixed with preheated air typically at an inlet venturi mixer and nozzle 51 which couples water feed piping 14 with preheated air feed piping 18 adjacent the piping outlets 14*a*. See also FIGS. 7 and 8. The air preheating is effected by passing the ambient air through a confined passage 42 defined by cylindrical wall 44 and over the motor 36 shown positioning in the passage 42 such that an annular convection heating zone 46 is created around the motor. A fan 48 suitably also driven by shaft 34 may be used to force the air across the motor 36 in greater volume. Low fan speeds and volume will be used because the air needs to pick up heat by convection as it traverses the motor 36. A second fan stage 50 may be used to slightly compress the air for added embullience in the tub, increased heat, or to increase air flow. Alternatively the second fan stage may be omitted as shown in FIG. 6. In either case, the preheated air enters plenum 58 and then exits the preheating apparatus 24 at outlet 58*a* and traverses the feed piping 18 to the venturi structure 51 wherein it is mixed with the feed water in piping 14 adjacent the outlet 14*a*, see FIG. 8 in particular.

Figure 8:
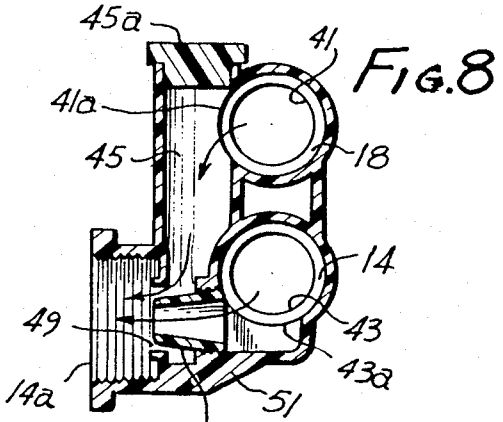
FIG. 8 is a view taken on line 8—8 in FIG. 7.
Figure 7:
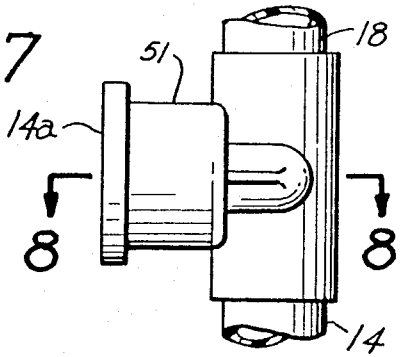
FIG. 7 is a fragmentary view of the venturi structure.

It is preferred to use a venturi structure 51 having a nozzle arrangement such as shown in FIGS. 7 and 8 for improved mixing of the air and water, and to induce air flow into the water by creating a localized low pressure zone adjacent the air supply. In this regard, the venturi structure 51 typically comprises a unitary plastic molded part having an internally threaded outlet opening 14*a* into which a complementary nut (not shown) is threaded to secure the structure to the wall of the tub 10. Upstream of the outlet opening 14*a* the structure 51 defines an upper coupling 41 which openly communicates with air feed piping 18, a lower coupling 43 which opening communicates with water feed piping 14, a venturi passage 45 closed by plug 45*a* at one end and communicating the upper coupling opening 41*a* with the outlet opening 14*a*, and a venturi nozzle 47 communicating the lower coupling opening 43*a* with the outlet 14*a*, concentrically with the lower terminus of the venturi passage such that water jetted through the venturi nozzle 47 draws the preheated air through the surrounding annulus 49 from air feed piping 18. The venturi structure 51 thus defines the terminus of the confined passage 42. The resulting mixing of water and air agitates the water as it enters the tub 10.

Figure 2:
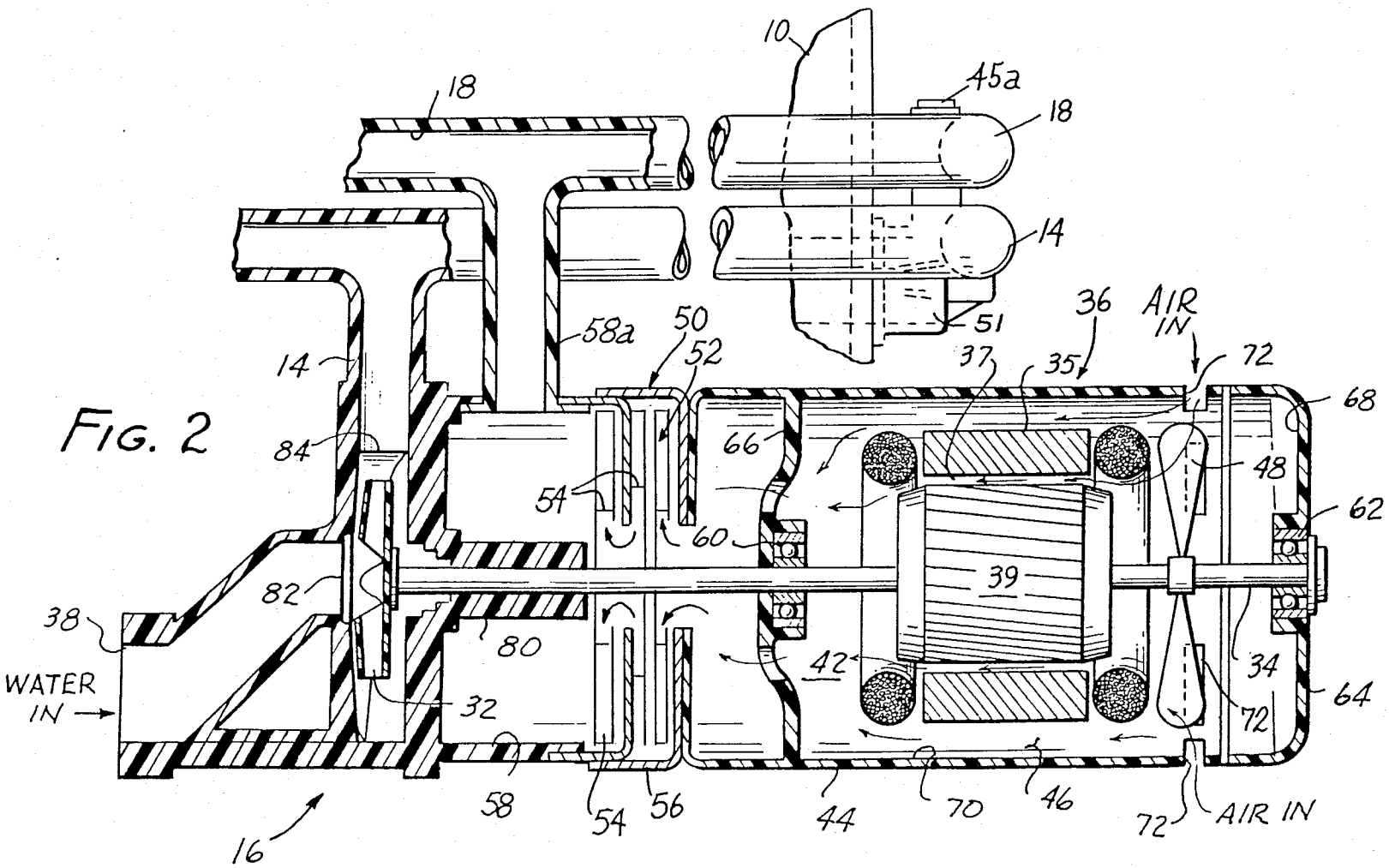
FIG. 2 is a view in vertical section of the air preheating apparatus.

One embodiment of the air preheater apparatus according to the invention is shown in detail in FIG. 2. There, shaft 34 extends centrally through the apparatus journaled in ball bearings 60, 62 in opposed vertical walls 66, 68 of the motor casing 64. Casing 64 is typically conventional and comprises in addition to the vertical walls 66, 68, a cylindrical wall 70 corresponding to the wall 44 in FIG. 1, the wall arrangement having circularly spaced ports 72 for inlet of ambient air as shown. Fan 48 is fixed to the shaft 34 with suitable gearing (not shown) as necessary for the purpose of urging air through an annular zone 46 defined by the wall 70 and the stator 35 of the motor 36 and though the gap 37 between the motor stator 35 and rotor 39, as shown by the arrows. Thus arranged, the zone 46 is a convection heating zone within which air is transitorily confined for heating with the heat given off by the motor 36. It may be noted here that a by-product of the air preheating is to increase the cooling effect around the motor 36 which enables running the motor at higher speeds and/or loads than would be typical for a given motor and to increase motor life.

The air past the motor 36, now preheated, e.g. to about 100 degrees F. plus or minus 10 or 20 degrees as desired, is displaced to the second stage compressor 50. The second stage compressor 50 is optional (cf. FIG. 6)

bit if used typically will increase air pressure slightly above atmospheric and comprises one or more turbine blade stages 52, 54 within housing 56 and which are suitably rotatably driven by the common shaft 34 and located beyond the motor casing 64. A plenum 58 beyond the housing 56 receives the now preheated, compressed air and delivers the same to plenum outlet 58*a* which meets the air feed piping 14 which communicates the air to respective venturi structures 51.

Shaft journal 80 extending centrally within plenum 58 supports the shaft 34 adjacent the impeller 32. Return piping 20 empties into the eye 82 of the impeller 32 and the impeller drives the water centrifugally out of outlet 84 into water feed piping 14.

With reference now to FIG. 6, where like parts have like numerals plus 100, shaft 134 extends centrally through the apparatus journaled in ball bearing bearings 160, 162 in opposed walls 166, 168, and there is a a cylindrical wall 170, the wall arrangement having circularly spaced ports 172 for inlet of ambient air as shown. Fan 148 is fixed to the shaft 134 for the purpose of urging air through an annular zone 146 defined by the wall 70 and the stator 135 of the motor 136 and through the gap 137 between the motor stator 135 and rotor 139, as shown by the arrows. Thus arranged, the zone 146 is a convection heating zone within which air is transitorily confined for heating with the heat given off by motor 136, with the same effects as obtained in the FIG. 2 embodiment.

The air past motor 136, preheated as in the FIG. 2 embodiment, is passed directly to the tube with a second fan stage. Accordingly, the heated air enters plenum 158 directly from the convection heating zone 146 whence it is passed to plenum outlet 159*a* and the air feed piping 18 therebeyond to the venturi structure 51. Impeller 132 operation is as in the FIG. 2 embodiment.

Figure 9:
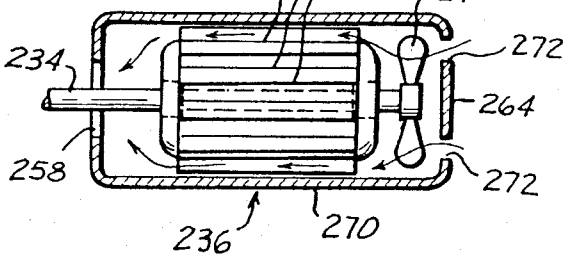
FIG. 9 is a fragmentary view partly of vertical section of an alternate motor and confined passage arrangement.

With reference now to FIG. 9, wherein like parts to FIG. 2 have the same numbers plus 200, motor 236 is totally enclosed by casing 264, the casing having circularly distributed longitudinal vanes 290 which serve as heat sinks for the motor within the casing. The motor 236 is enclosed by wall 270 having inlet ports 272 and outlet port 258 surrounding shaft 234. Fan 238 urges air along and across the vanes 290 to outlet 258 where it is captured by means not shown for delivery to the air feed piping 18.

In operation, the pump 36 is turned on after the tub 10 is filled with heated water, and the tub water circulates through the piping 14, 20. The operation of the pump drives the fan 48 and compressor 52 whereby air entering the casing 64 at ports 72 is confined by wall 70 into the annular convection heating zone 46 surrounding the motor and is thereby preheated. The air exits into the recirculating water at venturi structure 51 and is mixed with the water thereby.

Accordingly the foregoing objects of the invention have been met: to provide a hydrotherapy apparatus in which heat is maintained by the use of a low or no increased cost source, i.e. the motor of the water pump whereby ambient air is preheated before mixing with the recirculating water by convection against the pump motor.

The above described embodiments are merely representative of apparatus embodying the concept of this invention and are not to be considered as limiting. It is recognized that one skilled in the art may make changes in details or structure without departing from the spirit of this invention. The scope of this invention is defined not by the specific embodiments disclosed but by the following claims including their equivalents.

I claim:

1. In a hydrotherapy apparatus having a tub for containing a supply of heated water, a water pump for recirculating the heated water supply to and from the tub, a water pump motor for operating said water pump, and means for mixing ambient air into the heating water for air agitation thereof, the mixing means including a confined passage having a terminus in said means including a confined passage having a temperature tending to cool the heated water, the improvement comprising said water pump motor including a fan coupled to be driven by said water pump motor when it operates said water pump, said fan including an outlet adapted to be connected to said means for mixing ambient air with water from said water pump, said fan having as its inlet for ambient air a confined passage in thermal transfer relationship with said water pump motor whereby the heat generated by said water pump motor is introduced into the air moved by said fan past said water pump motor prior to mixing with water from said water pump.

2. The hydrotherapy apparatus according to claim 1 in which said confined passage has a locally relatively reduced cross-section defining a convection heating zone for air, said water pump motor at least partially defining said reduced passage cross-section.

3. The hydrotherapy apparatus according to claim 1 in which said confined passage comprises a wall in closely spaced relation with said water pump motor, said wall and water pump motor defining a convection heating zone therebetween.

4. The hydrotherapy apparatus according to claim 1, including also air compression means driven by said water pump motor within said confined passage for increasing the pressure of said ambient air above ambient pressure in advance of mixing with water from said water pump for improved air agitation of the water as it is introduced into the tub.

5. The hydrotherapy apparatus according to claim 1, further comprising air compression means between said water pump motor and said confined passage terminus, said air compression means comprising a compression turbine driven by said water pump motor and configured to increase the pressure of the air above ambient and urge the air toward said passage terminus.

6. The hydrotherapy apparatus according to claim 5 in which said water pump, said fan, and said compression turbine are driven by a common shaft of said water pump motor.

7. The hydrotherapy apparatus according to claim 1 in which said confined passage comprises a wall in closely spaced relation with said water pump motor, said wall and water pump motor defining a convection heating zone therebetween.

8. The hydrotherapy apparatus according to claim 7 in which said convection heating zone is generally annular and defined by said passage wall surrounding said water pump motor.

9. The hydrotherapy apparatus according to claim 8 including also within said passage, air compression means at the downstream side of said water pump motor after said convection heating zone, said air compression means comprising a turbine compressor for increasing the pressure of the air above ambient in advance of mixing air with the pumper water at said passage terminus for improved air agitation of said water.

10. The hydrotherapy apparatus in accordance with claim 1 in which said water pump and fan are mounted on a common shaft and in which said fan is located at one end of said water pump motor and the air inlet for said fan is at the opposite end of said water pump motor in which the operation of said water pump motor provides simultaneous pumping of water, heating and blowing of ambient air.

11. The hydrotherapy apparatus in accordance with claim 1 including a housing for said water pump motor including at least one opening at one end of said water pump motor and in which said confined passage includes the space between said water pump motor and its enclosing housing and said housing is operative to confine ambient air near the water pump motor to allow heat exchange heating of said ambient air.

12. The hydrotherapy apparatus in accordance with claim 1 in which said water pump motor has a single shaft, said fan is located adjacent to an air inlet for said water pump motor and coupled to said motor shaft at one end thereof;

a compressor stage is coupled to the motor shaft at the opposite end thereof and said water pump is coupled to said opposite end of said motor shaft;

whereby two stage movement of air, heating of the air, plus pumping of water is achieved in a single apparatus.

13. The hydrotherapy apparatus in accordance with claim 12, further comprising mixing means coupled to the output of said compressor stage for introducing air therefrom into water pumped by said water pump.

14. The hydrotherapy apparatus according to claim 1 in which said confined passage has a locally relatively reduced cross-section defining a convection heating zone for said air, said water pump motor at least partially defining said reduced passage cross-section.

15. A hydrotherapy apparatus comprising a water pump and water pump motor therefor, a heated water supply to be circulated by said water pump and water pump motor to and from a hydrotherapy tub, an air supply to be mixed with the water in agitating relation, and an air preheater comprising a wall defining an air supply passage, said wall enclosing said water pump motor for convection heating of said air supply within said passage in advance of mixing of the air with the water.

16. The hydrotherapy apparatus according to claim 15, further comprising air displacement means for urging air through said air supply passage in convection heating relation with said water pump motor.

17. The hydrotherapy apparatus of claim 16, wherein the water pump motor includes a rotatable shaft coupled to the water pump to drive the water pump, and the air displacement means including a fan coupled to the shaft to blow air in the air supply passage toward the water pump motor for convection heating in response to rotation of the shaft by the water pump motor.

18. A method of operating a hydrotherapy apparatus, the method comprising the steps of circulating heated water to and from a hydrotherapy tub with a motor driven water pump, mixing ambient agitating air into said water, and preheating said ambient agitating air by passing said air through a restricted passage across said water pump motor in heat exchange relation therewith before mixing with the water.

19. The method according to claim 18, further comprising the step of maintaining a pressure differential across said water pump motor to effect air flow thereacross in heat exchange relationship therewith.

20. In hydrotherapy apparatus having a tub for containing a supply of heated water, a water pump for recirculating the heated water supply to and from the tub, a water pump for operating said water pump, and means for mixing ambient air into the heating water for air agitation thereof, the mixing means including a confined passage having a terminus in said water, the ambient air normally being of a temperature tending to cool the heated water, the improvement comprising:

said water pump motor including a fan coupled to be driven by said motor when it operates said water pump, said fan including an outlet adapted to be connected to said means for mixing ambient air with water from said water pump;

said fan having as its inlet for ambient air a confined passage extending along the length of said motor in thermal relationship with said water pump motor whereby the heat generated by said water pump motor is introduced into the air moved by said fan past said water pump motor prior to mixing with water from said water pump;

wherein said confined passage around said motor includes a perforated baffle between said motor and the air outlet;

whereby substantially all air for said tub passes longitudinally along said motor and through said baffle.

21. In hydrotherapy apparatus having a tub for containing a supply of heated water, a water pump for recirculating the heated water supply to and from the tub, a water pump motor for operating said water pump, and means for mixing ambient air into the heating water for air agitation thereof, the mixing means including a confined passage having a terminus in the water, the ambient air normally being of a temperature tending to cool the heated water, the improvement comprising:

said water pump motor including a fan coupled to be driven by said motor when it operates said water pump, said fan including an outlet adapted to be connected to said means for mixing ambient air with water from said water pump;

said fan having as its inlet for ambient air a confined passage extending along the length of said motor in thermal relationship with said water pump motor whereby the heat generated by said water pump motor is introduced into the air moved by said fan past said water pump motor prior to mixing with water from said water pump;

wherein said water pump, fan and motor are contained in a single housing having an air inlet at one end thereof; and wherein said confined passage around said motor includes a perforated baffle between said motor and the air outlet;

wherein substantially all air for said tub passes longitudinally along said motor and through said baffle; and includes a second baffle separating said motor and air outlet from said pump.

* * * * *